United States Patent [19]

Scott et al.

[11] 3,998,015

[45] Dec. 21, 1976

[54] RESILIENT-EDGED WALLBOARD AND WALL ASSEMBLED THEREWITH

[75] Inventors: Junior L. Scott, Mount Prospect; Fred H. Zajonc, Palatine; John H. Crumbaugh, Clarendon Hills, all of Ill.

[73] Assignee: United States Gypsum Company, Chicago, Ill.

[22] Filed: July 26, 1973

[21] Appl. No.: 382,805

[52] U.S. Cl. ..... 52/222; 156/45; 52/406; 52/613

[51] Int. Cl.[2] ..... E04B 1/60; E04C 2/00; B32B 31/14

[58] Field of Search ..... 52/222, 596, 624, 627, 52/309, 406, 612, 552, 613; 161/43, 99, 102, 160, 44, 104, 161; 156/85, 39, 40, 45

[56] References Cited

UNITED STATES PATENTS

| | | | |
|---|---|---|---|
| 1,998,672 | 4/1935 | Hammond | 52/222 |
| 2,170,637 | 8/1939 | Hatch et al. | 52/584 |
| 3,141,206 | 7/1964 | Stephens | 52/406 |
| 3,146,827 | 9/1964 | Eckel | 49/9 |
| 3,226,284 | 12/1965 | Curtis | 52/613 |
| 3,265,547 | 8/1966 | Selbe | 156/85 |
| 3,312,585 | 4/1967 | Hamme | 52/309 |
| 3,350,257 | 10/1967 | Hourigan et al. | 161/43 |
| 3,708,935 | 1/1973 | Kossuth et al. | 52/416 |

FOREIGN PATENTS OR APPLICATIONS

| | | | |
|---|---|---|---|
| 910,156 | 11/1962 | United Kingdom | 52/309 |
| 971,202 | 9/1964 | United Kingdom | 52/309 |
| 1,094,606 | 12/1967 | United Kingdom | 52/309 |

*Primary Examiner*—James L. Ridgill, Jr.
*Attorney, Agent, or Firm*—Donnie Rudd; Samuel Kurlandsky; Robert H. Robinson

[57] ABSTRACT

A predecorated wall panel is disclosed for use in forming walls in which the joints between the panels are not to be finished. The panel includes a rigid core of green hydrated gypsum with a layer of resilient deformable material along at least one edge thereof being adhesively affixed thereto and a decorative sheet covering the front surface and side edge surface of the panel with a decorative sheet being under tension in the vicinity of one edge surface thereby partially compressing the deformable material and enabling two or more panels to be positioned with a core edge surface adjacent to each other thereby presenting an attractive appearance.

4 Claims, 7 Drawing Figures

RESILIENT-EDGED WALLBOARD AND WALL ASSEMBLED THEREWITH

BACKGROUND OF THE INVENTION

In the assembly of wallboard panels to form a wall, the trend is to provide predecorated panels which, when abutted edge to edge, form a joint which is not given a conventional coating of joint compound, but is left exposed. Such predecorated panels may comprise, for example, a gypsum core enveloped by a vinyl film, which displays a solid color or a patterned decoration. One example of such a panel is disclosed in U.S. Pat. No. 3,265,547.

As the joints between such panels are not further treated, the edge configuration of the panels is critical. Any deviation of the edge from an essentially planar surface results, when the edge is abutted against another panel of like design, in a gap between the panels. Such gaps are not only aesthetically unacceptable, they also contribute to loss of sound and thermal insulation.

Conventional predecorated gypsum panels have been prone to such gapping when assembled, for a number of reasons. Not only is it impossible to control manufacturing tolerances to produce only true, perfectly planar edge surfaces, deviations occur also because of damage to the edge surfaces during shipping. Also, gapping will occur if the panels are not erected with perfect vertical alignment. Thus, a gap or open area having edge separations as large as one thirty-second or one eighth of an inch may result from the assembly of conventional predecorated gypsum wallboard.

The conventional approach in overcoming such gapping is to rely on field expedients. For obvious reasons, the gapping does not become apparent until assembly of the panels, and the contractor may seek to correct it by jamming or hammering panels into closer contact, thus further damaging the edges of the panels. Such on-site solutions are therefore unacceptable.

Still another problem with conventional predecorated wallboard has been that the rigidity and non-adjustable width of the paneling has made it impossible to line up the wall joints with ceiling joints such as occur in suspended ceilings.

One approach that has been taken to avoid the problem is to wrap the decorative sheet around the edges so as to leave an air gap between the sheet and the core edges along the entire length of the edges. An example of such a construction is shown in U.S. Pat. No. 3,226,284. The difficulty with such an approach is that the sheet, by being unsupported at the edges, collapses upon assembly of the panels edge to edge to the point at which beading results. "Beading" is the protrusion of the sheet out of the general plane of the rest of the sheet, creating an unsightly ridge. It is thus necessary that a solution be found which will not create the unacceptable alternative of "beading."

A resilient edging has been provided in insulation panels used in refrigerated vehicles, of which U.S. Pat. No. 3,141,206 is an example. Such a construction, however, has not been used in a predecorated gypsum wall panel.

SUMMARY OF THE INVENTION

This invention concerns an improvement of predecorated gypsum panels and walls assembled therefrom, so as to provide the panel with a resilient edge having sufficient compressibility to fill gaps between panels which would otherwise occur. At the same time the edge has been constructed so as to prevent beading. More specifically, there is provided in a wall panel including a core comprising rehydrated gypsum and having a front surface and two side edge surfaces, and a decorative sheet covering at least a portion of the front surface and the edge surfaces; the improvement comprising a layer of resilient material positioned between the sheet and the core adjacent to and covering at least a portion of at least one of the edge surfaces along substantially the entire length thereof, the sheet being under tension and secured so as to at least partially compress the material, whereby two of the panels may be adjoined with the edges thereof in contiguous abutment without creating a bead in the sheet protruding out of the surface of the sheet.

Accordingly, it is an object of the invention to provide a predecorated gypsum panel and wall assembled therefrom wherein the edge of the panels adjustably fills any gaps between the panels, without creating protrusions in the predecorated surface of the panels.

It is a related object of the invention to provide such a panel and wall wherein the width of the panel from edge to edge can be adjusted to align the panel joints in the ceiling.

Other objects and advantages will become apparent upon reference to the following brief discussion of the drawings and description of the preferred embodiments.

DESCRIPTION OF THE PREFERRED EMBODIMENTS

The disclosure relates to gypsum panels and the assembly thereof preferably into a permanent wall. Particularly the invention may be used with predecorated panels wherein the joints between panels cannot be finished subsequently.

Figure 1:
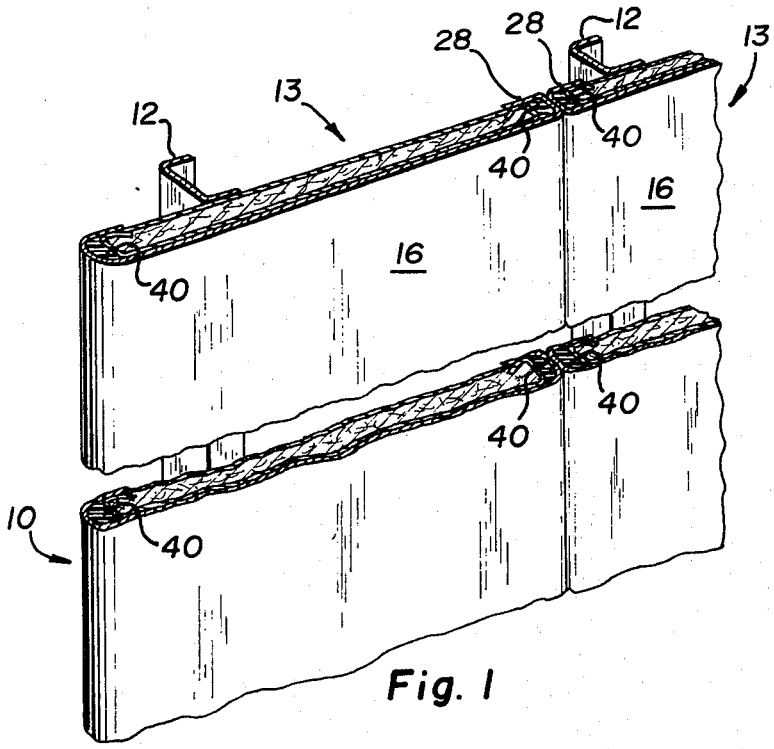
FIG. 1 is a fragmentary perspective view of a portion of a wall assembly featuring the invention.
Figure 2:
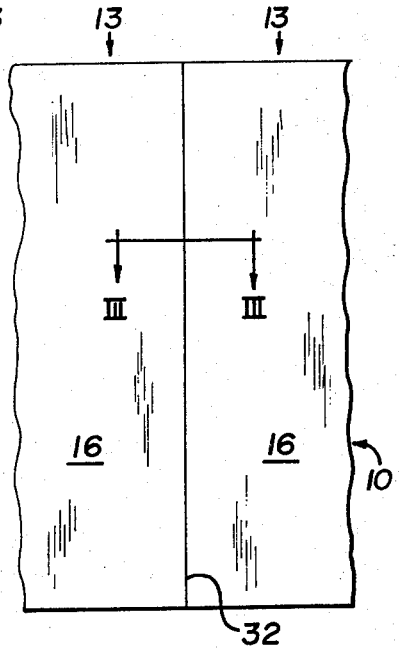
FIG. 2 is a fragmentary front elevational view of the wall assembly shown in FIG. 1.

Such a wall 10 is partially illustrated in FIGS. 1 and 2, wherein conventional studs 12, here shown to be "C" channels, secure adjacent panels 13 in an upright position, attachment being made either by conventional adhesive, or by fasteners, not shown, having a decorative head matched to the decorative coloring of the panel. The far side of the wall, not shown, attached to the other flanges of the studs 12, may either be conventional structure or it may be a mirror image of the panels of the invention.

Figure 3:
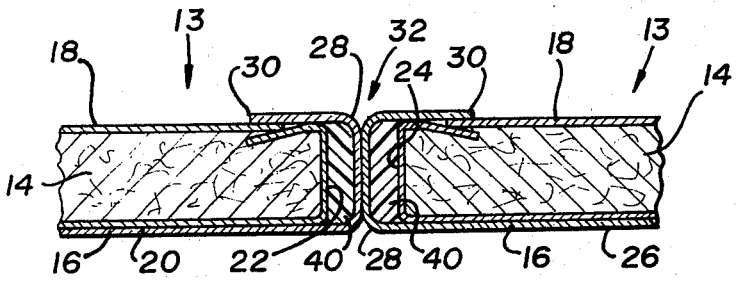
FIG. 3 is a sectional view taken along the line III—III of FIG. 2.
Figure 4:
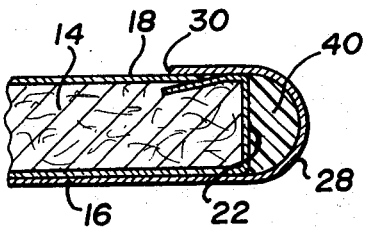
FIG. 4 is a fragmentary sectional view similar to FIG. 3, but illustrating only one of the panels prior to its assembly in a wall.

The panels 13 comprise a conventional core 14 and a decorative sheet or envelope 16, which may be vinyl or other suitable, and conventional, material. As shown particularly in FIGS. 3 and 4, the core comprises a body of rehydrated gypsum over which a paper cover sheet 18 may be conventionally adhered. The sheet may be all one piece, or comprise a front and back sheet as shown. The core is defined by a front surface 20 and spaced apart side edge surfaces 22 and 24. The sheet 16 in turn has an exposed front face 26 and edge portions 28 defining the side edge portions of the panel. Extreme edges 30 of the sheet 16 are preferably secured to the back of the panel by any suitable, conventional adhesive. When the panels are assembled, adjacent edge portions 28 define a joint 32, which when constructed according to the invention, is free from gaps (FIG. 2)

In accordance with one aspect of the invention, a layer of resilient, deformable material 40 is positioned under the sheet 16 along at least a portion of the edge surfaces 22 and 24. The material is preferably secured to the core by a conventional adhesive, and partially compressed by the sheet 16 which is wrapped over it. The partial compression is best achieved by pulling the sheet 16 under tension, as described below, prior to securing the extreme edges 30.

Material 40 is preferably a compressible foamed plastic or elastomer such as polyvinyl chloride, polyester, polyurethane, polyether, polyethylene, polychlorobutadiene, polyacrylate, natural rubber, styrene-butadiene copolymers, and ethylene-propylene copolymers. In addition, it may also be formed from non-foamed elastomers, or even a felt or corrugated paper. In any event, the panel edge, prior to assembly with other panels into a wall, must have a residual compressibility or resiliency permitting the edge to be compressed at least about 10 mils, in a direction perpendicular to edge surface 22 and 24, when a pressure of at least about 0.01 lbs. per lineal inch is applied. Such further compressibility permits two panels to be abutted readily, edge-to-edge, so that the sheets 16 thereof are in contiguous and intimate contact along the entire edge portions of the panels, leaving no gaps between them.

The thickness of the material 40 as measured from the edge surface 22 or 24 to the sheet 16, prior to assembly in a wall (FIG. 4) is preferably between about 0.02 inches and about 0.5 inches. The actual selection will depend upon the degree of expected deviation in planar edges caused by manufacturing tolerances and other factors. Deviations smaller than 20 mils are not generally noticeable, and a preferable thickness is approximately 0.03 inches.

Figure 5:
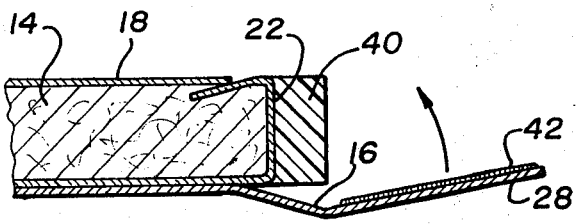
FIG. 5 is a fragmentary sectional view schematically illustrating the method of assembly of the panel shown in FIG. 4.

In accordance with another aspect of the invention, it has been found necessary that the material 40 be given a partial compression by the cover sheet. Otherwise, a bead will form in sheet 16 at edge portion 28. This compression is readily achieved, FIG. 5, by securing the material 40, which can have any desired cross sectional shape, to the edge surface 22 by an adhesive, and then wrapping sheet 16 around material 50 to partially compress it into generally a half-moon shape. With the sheet 16 thus under tension, it is secured by adhesive 42 to the back of the panel.

An example, which is illustrative only and in on way limiting, was prepared as follows:

A squared strip of polyester foam 0.5 inches thick and 0.5 inches wide having a density of 2 pounds per cubic foot (PCF) was obtained from Pres-On Products Inc., 39 Factory Road, Addison, Illinois, with a pressure-sensitive adhesive on the backside. This was adhered to the edge surface of a half-inch wide, conventional vinyl-enveloped gypsum board, and the sheet of vinyl film or sheet attached to the front surface of the board was pulled over the foam about 0.25 to 0.3 inches. The film was secured to the back of the panel. The resulting panel edge had a residual compressibility of 0.010 inch for an applied force of 0.019 pounds per lineal inch. Neither gapping nor beading occurred when the panel was tested in a wall assembly.

Figure 6:
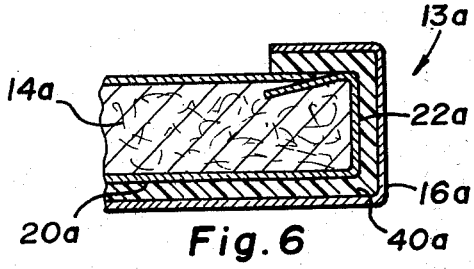
FIGS. 6 and 7 are fragmentary sectional views similar to FIG. 4 but illustrating alternate embodiments of the invention.

FIG. 6 illustrates an alternate embodiment wherein the resilient material is a foam laminated to the vinyl sheet. Parts similar to those previously described bear the same reference numeral to which the distinguishing suffix "*a*" has been added. Thus, panel 13*a* comprises a core 14*a* having an edge surface 22*a*, a tensioned, vinyl sheet 16*a* enclosing the core, and a resilient material 40*a* disposed between the sheet 16*a* and edge surface 22*a*. The composition of material 40*a* may be the same as the previous embodiment. However, unlike the previous embodiment, the material 40*a* extends over the entire front surface 20*a* of the core under the sheet. The most practical method of achieving this construction is to use a sheet 16*a* to which the foam is prelaminated. A plasticized polyvinyl chloride film 16*a* preformed with a closed cell, foamed back surface forming the material 40*a* may be used, for example, preferably with an uncompressed thickness at least equal to 0.02 inches, and a density of about 12 PCF. The sole requirement is that it have a residual compressibility of 10 mils for a pressure of at least about 0.01 pounds per lineal inch. Higher densities may be utilized, but foamed sheets having a density in excess of about 35 PCF require excessive force to obtain the necessary 10 mil compression upon assembly of the panels edge to edge.

As before, the sheet 16*a* is tensioned enough to partially compress the foam 40*a*, to prevent beading.

Figure 7:
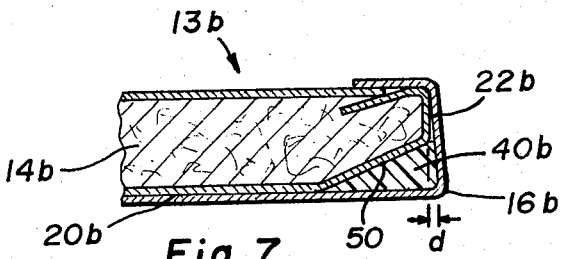

FIG. 7 illustrates yet another embodiment, wherein the resilient material is positioned over only a portion of the edge surface, which portion slopes away from the front surface of the panel to give a tapered edge. Parts similar to those previously described bear the same reference numeral, to which the distinguishing suffix *b* is applied. Thus, panel 13*b* comprises a core 14*b* having a front surface 20*b* and an edge surface 22*b*, a decorative sheet 16*b*, and a resilient material 40*b* positioned between the sheet 16*b* and the edge surface 22*b*. In this case, however, edge surface 22*b* joins the front surface 20*b* by a sloping porition 50 which slopes away from the front surface towards the back of the panel, defining a so-called tapered edge. The resilient material 40*b*, which may be identical in composition with the other embodiments, is adhered to portion 50 and slightly compressed by the tension of sheet 16*b*. It is essential, however, after the panel is manufactured, that the resilient material protrude outwardly away from the core beyond the side limits of the edge surface 22*b* a distance *d*, which distance must at least equal the amount of compression which is desired to prevent gapping when the wall is assembled. Preferably, therefore, the distance *d* equals at least 10 mils.

Although the invention has been described in connection with certain preferred embodiments, it is not necessarily limited thereto. Rather, it is intended that it cover all alternatives, equivalents, and alternate embodiments as may be included within the scope of the following claims.

What is claimed is:

1. A pre-decorated wall panel for use in forming walls in which the joints between panels are not to be finished, comprising:

1. a rigid core consisting essentially of rehydrated gypsum and having front and rear surfaces and spaced-apart side edge surfaces,
2. a layer of resilient, deformable material disposed along at least a portion of at least one of said core side edge surfaces and being adhesively affixed to at least a portion of a surface of said core, and
3. a decorative sheet covering the front surface and side edge surfaces of said panel and said layer of resilient deformable material, and being adhesively affixed to the back of said panel, said decorative sheet being under tension in the vicinity of said one core edge surface thereby partially compressing said deformable material, whereby two or more panels may be positioned with their core edge surfaces adjacent to each other and with said resilient material further compressed to form to joint between the panels wherein the sheets of adjacent panels are in intimate and contiquous contact along the panel edge portions, and wherein said resilient material is disposed between said sheet and said core over the entire core front surface and said one core edge surface.

2. A pre-decorated wall panel for use in forming walls in which the joints between panels are not to be finished, comprising:

1. a rigid core consisting essentially of rehydrated gypsum and having front and rear surfaces and spaced-apart side edge surfaces,
2. a layer of resilient, deformable material disposed along at least a portion of at least one of said core side edge surfaces and being adhesively affixed to at least a portion of a surface of said core, and
3. a decorative sheet covering the front surface and side edge surfaces of said panel and said layer of resilient deformable material, and being adhesively affixed to the back of said panel, said decorative sheet being under tension in the vicinity of said one core edge surface thereby partially compressing said deformable material, whereby two or more panels may be positioned with their core edge surfaces adjacent to each other and with said resilient material further compressed to form a joint between the panels wherein the sheets of adjacent panels are in intimate and contiguous contact along the panel edge portions, and wherein said core edge surface is joined to said core front surface by a portion sloping away from the front surface, whereby a tapered core edge is formed, and wherein said resilient deformable material is disposed over said sloping portion and protrudes outwardly away from said core beyond the side limits of said core edge surface.

3. An assembly of a plurality of pre-decorated panels, each comprising:

1. a rigid core consisting essentially of rehydrated gypsum and having front and rear surfaces and spaced-apart side edge surfaces,
2. a layer of resilient, deformable material disposed along at least a portion of at least one of said core side edge surfaces and being adhesively affixed to at least a portion of a surface of said core, and
3. a decorative sheet covering the front surface and side edge surfaces of said panel and said layer of resilient deformable material, and being adhesively affixed to the back of said panel, said decorative sheet being under tension in the vicinity of said one core edge surface thereby partially compressing said deformable material, said panels being positioned with their core edge surfaces adjacent to each other and with the resilient deformable material further compressed to a form a joint between the panels wherein the sheets of the panels are in intimate and contiguous contact with the sheets of adjacent panels along the panel edge surfaces, and wherein said resilient deformable material is disposed between said sheet and said core over the entire core front surface and said one core edge surface.

4. An assembly of a plurality of pre-decorated panels, each comprising:

1. a rigid core consisting essentially of rehydrated gypsum and having front and rear surfaces and spaced-apart side edge surfaces,
2. a layer of resilient, deformable material disposed along at least a portion of at least one of said core side edge surfaces and being adhesively affixed to at least a portion of a surface of said core, and
3. a decorative sheet covering the front surface and side edge surfaces of said panel and said layer of resilient deformable material, and being adhesively affixed to the back of said panel, said decorative sheet being under tension in the vicinity of said one core edge surface thereby partially compressing said deformable material, said panels being positioned with their core edge surfaces adjacent to each other and with the resilient deformable material further compressed to form a joint between the panels wherein the sheets of the panels are in intimate and contiguous contact with the sheets of adjacent panels along the panel edge surfaces, and wherein said core edge surface is joined to said core front surface by a portion sloping away from the front surface, whereby a tapered core edge is formed, and wherein said resilient deformable material is disposed over said sloping portion and protrudes outwardly away from said core beyond the side limits of said core edge surface.

* * * * *

UNITED STATES PATENT OFFICE

CERTIFICATE OF CORRECTION

Patent No. 3,998,015 Dated December 21, 1976

Inventor(s) Junior L. Scott, Fred H. Zajonc, John H. Crumbaugh

It is certified that error appears in the above-identified patent and that said Letters Patent are hereby corrected as shown below:

Col. 3, line 61, after in, "on" should read -- no --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*